United States Patent [19]

Hidaka

[11] Patent Number: 4,518,965

[45] Date of Patent: May 21, 1985

[54] TUNED SMALL LOOP ANTENNA AND METHOD FOR DESIGNING THEREOF

[75] Inventor: Kazutaka Hidaka, Yokohama, Japan

[73] Assignee: Tokyo Shibaura Denki Kabushiki Kaisha, Kawasaki, Japan

[21] Appl. No.: 348,206

[22] Filed: Feb. 12, 1982

[30] Foreign Application Priority Data

Feb. 27, 1981 [JP] Japan ..... 56-26910

[51] Int. Cl.[3] ..... H01Q 11/12

[52] U.S. Cl. ..... 343/742; 343/743; 343/744; 455/193

[58] Field of Search ..... 343/741-744, 343/748, 788, 866-868, 870, 842, 855, 857, 861; 455/274, 193, 82, 272, 275, 188

[56] References Cited

U.S. PATENT DOCUMENTS

| | | | |
|---|---|---|---|
| 2,467,962 | 4/1949 | Caraway et al. | 343/742 |
| 2,551,664 | 5/1951 | Galper | 343/741 |
| 3,588,905 | 6/1971 | Dunlavy, Jr. | 343/741 |
| 3,631,499 | 12/1971 | Turner | 343/744 |
| 3,641,576 | 2/1972 | Farbanish | 343/743 |
| 3,680,127 | 7/1972 | Richard | 343/748 |
| 3,956,751 | 5/1976 | Herman | 343/744 |
| 4,342,999 | 8/1982 | Woodward et al. | 343/742 |

FOREIGN PATENT DOCUMENTS

| | | | |
|---|---|---|---|
| 973146 | 12/1959 | Fed. Rep. of Germany | 343/744 |
| 54-41192 | 12/1979 | Japan . | |
| 1307648 | 2/1973 | United Kingdom | 343/742 |

OTHER PUBLICATIONS

R. W. P. King et al., "Antennas and Waves: A Modern Approach", MIT Press, pp. 437-438, (1969).

"Antenna Engineering Handbook", *The Institute of Electronics & Communication Engineers of Japan*, Chapter 7, pp. 319-321, (1980).

*Primary Examiner*—Eli Lieberman

*Assistant Examiner*—Michael C. Wimer

*Attorney, Agent, or Firm*—Banner, Birch, McKie & Beckett

[57] ABSTRACT

The invention is directed to a tunable loop antenna design which provides impedance matching between the loop antenna and a feed line despite variations of the resonant frequency $f_o$ over a wide range of frequencies. The antenna has a maximum length of one tenth of the wavelength, and comprises a loop conductor and a variable capacitor connected in series with the conductor for providing a resonant circuit. The loop area of the conductor, the circumferential length and equivalent radius thereof are adjusted so that the ratio of the resonant frequency $f_o$ of the antenna and the resonant frequency $f_m$, at which the input admittance is a minimum, is within the range:

$0.5\text{-}f_o/f_m\text{-}3.0.$

10 Claims, 13 Drawing Figures

TUNED SMALL LOOP ANTENNA AND METHOD FOR DESIGNING THEREOF

BACKGROUND OF THE INVENTION

This invention relates to a small loop antenna and especially to a tunable small loop antenna which includes a variable capacitive element connected in a series with the loop conductor.

Recently, the demand for small antennas which can be installed in television receivers, radio receivers or can be used as an external portable antenna system, has been growing in the field of consumer electronics. Such demand is also growing in the field of traveling wireless communications, such as taxi radio communications and citizen band transceivers because the size of the transmitters and receivers, incorporated in these systems, are becoming smaller due to the remarkable developments made with integrated circuits.

Generally, the size of the antenna is related to the wavelength of the radiowaves employed. The longer the wavelength, the larger the antenna size. This invention relates to small antennas, the maximum length of which is not more than one tenth of the wavelength used. Accordingly, hereinafter, the term "small antenna" refers to antennas having a maximum length of not more than one tenth of the wavelength employed. The maximum size of the loop antenna according to the invention is defined here as the maximum length between two opposite outer edges of the loop conductor. For example, in the case of circular loop antenna (e.g., FIG. 6) the maximum size is the outer diameter of the loop conductor; in the case of a square loop antenna (e.g., FIG. 10) it is the diagonal length measured from its outer edges.

A variety of small loop antennas includes the tuned small loop antenna. Tuned loop antennas have a fixed capacitive element connected in series with a one-turn loop conductor. The value of the capacitive element and the inductance of the loop is selected so that the circuit is tuned to the desired frequency of the radiowaves employed. One example of such an antenna is shown in U.S. Pat. No. 3,641,576. This antenna is formed on a disc substrate by printed circuit techniques. It has a diameter of approximately 5 inches and is small enough for use in portable radio equipment. This antenna, however, is designed to have a low loaded "Q" value of not more than 10 so as to cover a wide range of FM frequencies. Low "Q" antennas have low gain and, consequently, the sensitivity of such an antenna is low. It is well known to persons skilled in the art that antennas with high sensitivity, and therefore high gain, can be provided by designing the antenna with a high loaded Q value. Such antennas, however, have a narrow bandwidth and are impractical for transmitting or receiving radio or television broadcasting signals which require the wide band coverage.

To overcome the disadvantages of conventional small loop antennas mentioned above, it is possible to utilize a variable capacitance as the capacitive element connected in series with the loop conductor; the variable capacitance can then be adjusted to tune in the desired frequency. Changing the capacitance, however, produces an undesirable change in the input impedance of the antenna.

Therefore, it is difficult to establish the requisite impedance matching between the antenna and the constant standard impedance of the feeder line. One obvious method of correcting this problem is to mechanically adjust, each time the capacitance is varied, the separation of the antenna input/output taps which are coupled to the feeder line. This mechanical adjustment is not desirable, however, for two reasons. First, the tap design (e.g., slidable contact) to accomplish the precise separation would be costly and complicated. Second, the additional resistance necessarily added by a slidable contact design would cause a decrease in the gain and sensitivity of the antenna.

SUMMARY OF THE INVENTION

It is an object of the present invention to provide a small loop antenna overcoming the disadvantages mentioned above, having high gain and large tuning range while maintaining impedance matching.

It is a further object of the present invention to provide a high gain antenna having a directional pattern similar to a dipole antenna.

It is still a further object of the present invention to provide a tunable antenna having a gain substantially better than conventional tuned loop antennas.

It is therefore one object of the invention to provide a high gain antenna having a maximum length of not more than one-tenth of the wavelength and having a loaded Q of more than 20 whereby the resonant frequency of the antenna can be varied over a wide frequency range while maintaining impedance matching and without requiring any mechanical adjustments of the taps.

The instant invention is directed to a loop antenna having a particular design such that the input admittance of the loop antenna has a minimal variation over a particular frequency range. In particular, the structure of the loop antenna of the instant invention is defined by the following parameters: the loop area of the conductor (A); the loop circumferential length (S); and the equivalent radius (b) of the loop conductor. In accordance with this invention, a particular frequency (hereinafter described as $f_m$) is selected which gives the minimum input admittance of the antenna when specific parameters are employed. According to the invention, the loop antenna is designed by selecting the loop area of the conductor (A), the circumferential length (S) and equivalent radius (b) thereof so that the ratio of the resonant frequency $f_o$ of the antenna and resonant frequency $f_m$ (i.e., the frequency at which the antenna input admittance is a minimum) falls within the following range:

$$0.5 \leqq f_o/f_m \leqq 3.0$$

BRIEF DESCRIPTION OF THE DRAWINGS

The features of the present invention which are believed to be novel are set forth with particularity in the appended claims. The invention, together with further objects and advantages thereof, may best be understood by reference to the following description taken in connection with the accompanying drawings.

DESCRIPTION OF THE PREFERRED EMBODIMENTS

Figure 1:
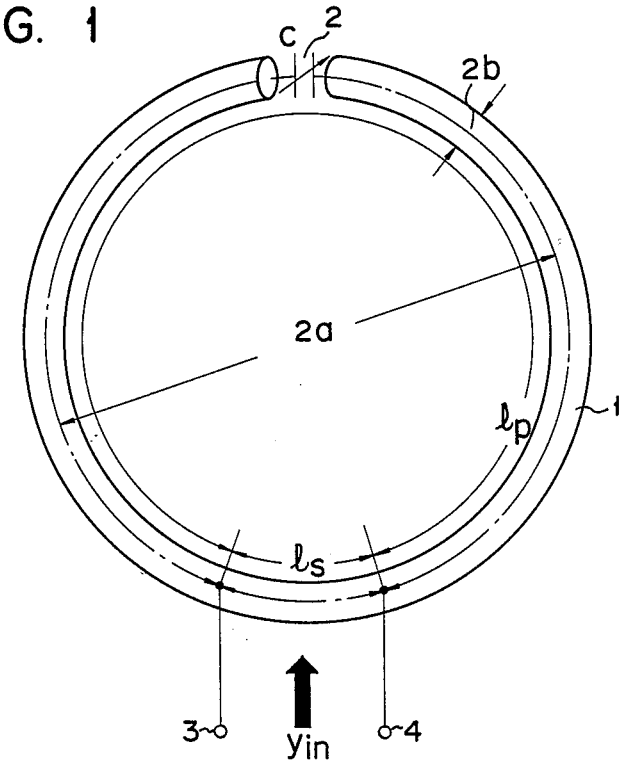
FIG. 1 is a plan view of a tuned loop antenna used in explaining the principles of the invention.

The following theoretical explanation is given with reference to FIGS. 1–5 in order to explain the features of the instant invention. Shown in FIG. 1 is a loop conductor having a radius a and a cross-sectional radius b. A variable capacitive element 2 is connected in series with the loop conductor 1. Taps 3 and 4 are connected along the loop conductor and are circumferentially spaced by the length $l_s$. A feeder line (not shown) is connected to taps 3 and 4 for providing a signal to, or receiving a signal from, loop conductor 1. The circumferential length S of the loop conductor 1 represents the sum of the length of the arcs $l_p$ and $l_s$. Length $l_s$ is the arc length separating taps 3 and 4. Length $l_p$ is the arc length representing the remainder of the circumference of loop 1.

Figure 2:
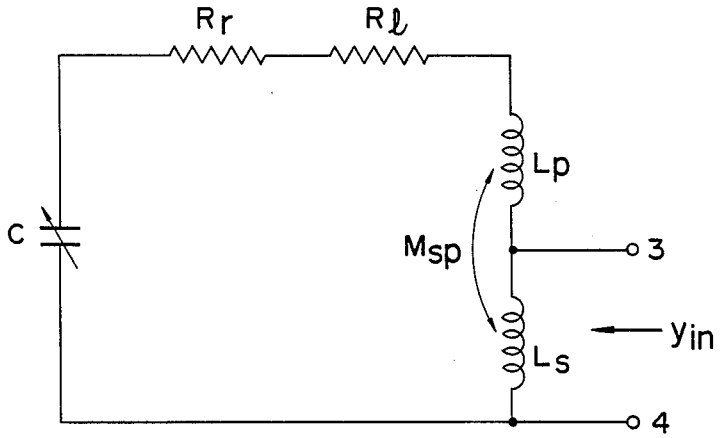
FIG. 2 is a schematic diagram of the equivalent circuit for the antenna shown in FIG. 1.

An electrical equivalent circuit for the antenna shown in FIG. 1 is shown in FIG. 2. In FIG. 2, $L_p$ and $L_s$ represent the self inductance of the arc lengths $l_p$ and $l_s$, respectively, of the loop conductor shown in FIG. 1. C is the capacitance of the variable capacitive element 2. $M_{sp}$ is the mutual inductance between the sections $l_s$ and $l_p$. $R_r$ and $R_l$ are the radiation resistance and the loss resistance, respectively, of the loop antenna. The input admittance $y_{in}$ of the small loop antenna as seen from taps 3 and 4, is expressed by the following equation:

$$y_{in}(f_o) = \frac{R_r + R_l}{(L_s + M_{sp})^2} \cdot \frac{1}{w_o^2} \tag{1}$$

where $w_o$ is a resonant angular frequency $2f_o$. In equation (1), the unit of $f_o$ is hertz (Hz), the units of $L_s$ and $M_{sp}$ are henrys (H) and the units of $R_r$ and $R_l$ are ohms (r).

As known, the radiation resistance $R_r$ is, given by the following equation:

$$R_r = \frac{320\pi^4 A^2}{\lambda_o^4} \tag{2}$$

where A is loop area surrounded by the loop conductor 1 and $\lambda_o$ is the wavelength of the resonance frequency expressed by $\lambda_o = 3\times 10^8/f_o$(m).

As is also known, the loss resistance $R_e$ of the loop antenna is given by the following equation:

$$R_e = \frac{1}{2\pi} \cdot \frac{s}{b} \cdot \sqrt{\frac{w_o\mu}{2\sigma}} \tag{3}$$

where s=loop circumferential length (m)

s=2πa (i.e., in the case of a circular loop)

b=radius of the loop conductor (m)

σ=conductance of the loop conductor (℧/m)

μ=the permeability of the medium surrounding the loop conductor (H/m).

Substituting the equation (2) and (3) into equation (1), the following equation is obtained:

$$y_{in}(f_o) = \frac{10^{-32}\pi^4 A^2}{(L_s + M_{sp})^2}\left\{ f_o^2 + \frac{10^{32}}{8\pi^4\sqrt{\pi}} \sqrt{\frac{\mu}{\sigma}} \cdot \frac{1}{M} \cdot f_2^{-1.5} \right\} \tag{4}$$

where $$M = A^2 b/S \tag{5}$$

As shown by equation (5), M is defined by parameters A, b and S, which relate to the structure of the loop antenna. Therefore, M is hereinafter called the structural parameter of the loop antenna.

The self inductance $L_s$ and the mutual inductance $M_{sp}$ are determined only by the construction and materials of loop conductor 1 and parameter A; $L_s$ and $M_{sp}$ are independent of the resonant frequency $f_o$. Therefore, equation (4) can be rewritten more clearly as follows:

$$y_{in}(f_o) = K\left\{ f_o^2 + \left(7.24 \times 10^{28}\sqrt{\frac{\mu}{\sigma}} \cdot \frac{1}{M}\right) f_o^{-1.5} \right\} \tag{6}$$

where $$K = \frac{10^{-32}\pi^4 A^2}{(L_s + M_{sp})^2} \tag{7}$$

As can be seen from equation (6), $y_{in}(f_o)$ is expressed as a function of the resonant frequency $f_o$ and the selected structural parameter M. Clearly, if M is given, the function $y_{in}(f_o)$ is a quadratic function of $f_o$.

Taking a differential of $y_{in}(f_o)$ with respect to $f_o$ and calculating the following equation:

$$\frac{\partial\, y_{in}(f_o)}{\partial f_o} = 0 \tag{8}$$

the frequency at which the input admittance is a minimum can be obtained. This frequency, hereinafter referred to as $f_m$, is expressed by the following equation:

$$f_m = 1.62\times 10^8 (\mu/\sigma)^{1/7} (1/M)^{2/7} \tag{9}$$

Equation (9) can be rewritten using the structural parameter given by equation (5) as follows.

$$f_m = 1.62 \times 10^8 \left(\frac{\mu}{\sigma}\right)^{\frac{1}{7}} \left(\frac{S}{A^2 b}\right)^{\frac{2}{7}} \tag{10}$$

or

-continued $$\frac{A^2b}{S} = 5.43 \times 10^{28}\sqrt{\frac{\mu}{\sigma}} \cdot f_m^{-\frac{7}{2}} \tag{10'}$$

It is clear from equation (10) or (10') that the particular resonant frequency which makes the input admittance a minimum is determined by dimensions of the antenna (i.e., S, b and A), conductance of the loop conductor and permeability of the medium surrounding the loop conductor. Consequently, it is possible to adjust the frequency $f_m$ to the desired value by selecting the dimensions and material of the antenna.

Rewritting equation (4) with equation (10) or (10''), we obtain the following equation:

$$y_{in}(f_o) = Kf_m^2\left\{\left(\frac{f_o}{f_m}\right)^2 + 1.33\left(\frac{f_o}{f_m}\right)^{-1.5}\right\} \tag{11}$$

Substituting $f_o$ with $f_m$, the following is obtained:

$$Y_{in}(f_m) = 2.33kf_m^2 \tag{12}$$

Equation (12) shows the minimum input admittance of the tuned loop antenna. Normalizing the input admittance by the minimum input admittance, the normalized input admittance $y_{in}(f_o)$ is expressed from equation (11) and (12) as follows.

$$y_{in}(f_o) = \frac{y_{in}(f_o)}{y_{in}(f_m)} = 0.429\left\{\left(\frac{f_o}{f_m}\right)^2 + 1.33\left(\frac{f_o}{f_m}\right)^{-1.5}\right\} \tag{13}$$

(13)

Figure 3:
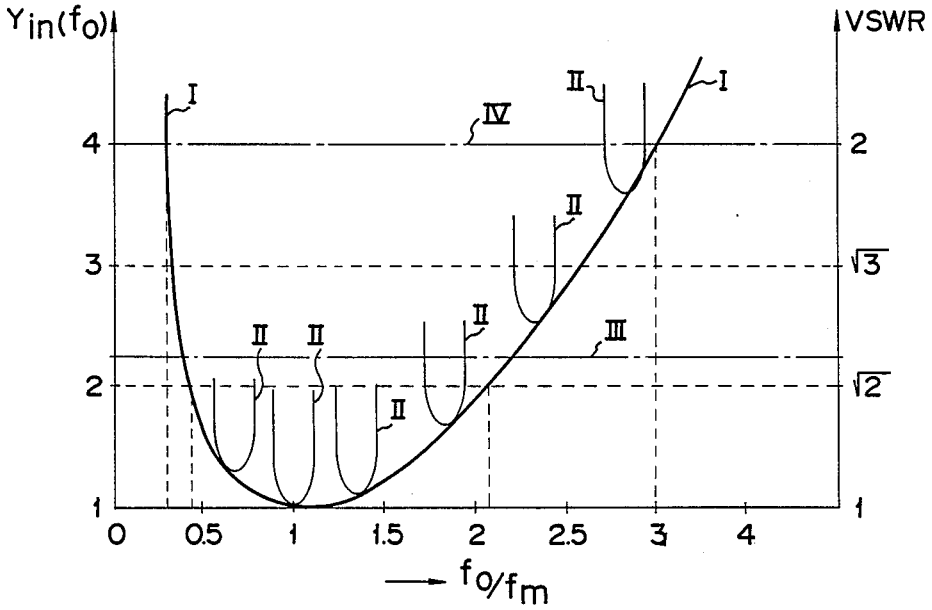
FIG. 3 is a graph I showing the input admittance frequency characteristics for the antenna shown in FIG. 1 for various capacitance of capacitor element 2. Graphs II are the frequency resonant curves for various capacitance of capacitive element 2.

The curve I in FIG. 3 shows the graph of $y_{in}(f_o)$ for various resonant frequencies $f_o$ of the tuned loop antenna where the frequency $f_o$ on the horizontal axis is also normalized by the frequency $f_m$. This curve I of FIG. 3 shows the variations of the normalized input admittance of the tuned antenna shown in FIG. 1, as seen from tap points 3 and 4, in accordance with the variation of the capacitive element 2. Varying capacitive element 2 causes a change in the resonant frequency $f_o$ of the antenna. Shown in FIG. 3 are various resonant frequency curves II, each corresponding to a different resonant frequency $f_o$ obtained by varying the capacitive element 2.

It is clear from FIG. 3 that the input admittance $y_{in}(f_o)$ of the tuned loop antenna becomes minimum at the point where $f_o/f_m=1$ or $f_o=f_m$ and it increases gradually on the both sides of the point $f_o/f_m=1$. It can be seen that $y_{in}(f_o)$ increases rapidly in the range of $f_o/f_m<0.5$. Therefore it is clear from FIG. 3 that input admittance $y_{in}(f_o)$ does not appreciably change about the point $f_o/f_m=1$. Thus, in the frequency range about $f_o/f_m=1$, substantial impedance matching can be obtained over a wide range of frequencies provided operation occurs about point $f_o/f_m=1$. However, in the range of $f_o/f_m<0.5$, it is difficult to maintain matching since the input impedance appreciably varies. This is so even if the capacitance of capacitive element 2 is slightly varied.

The matching conditions between an antenna and a feeder line can generally be indicated by the voltage standing wave ratio (VSWR). As is well known to a person skilled in the art, the VSWR for a transmission line connected to an antenna can be expressed as follows:

$$S = \frac{1 + |\Gamma|}{1 - |\Gamma|} \tag{14}$$

where s=VSWR in the transmission line (i.e., feeder),

Γ=reflection coefficent at the connecting point between the antenna and the transmission line.

It is also known that the input impedance of the antenna normalized by the standard admittance $y_o$ of the transmission line can be expressed as follows:

$$\frac{y_{in}(f_o)}{y_o} = \frac{1 - \Gamma}{1 + \Gamma} \tag{15}$$

Figure 4:
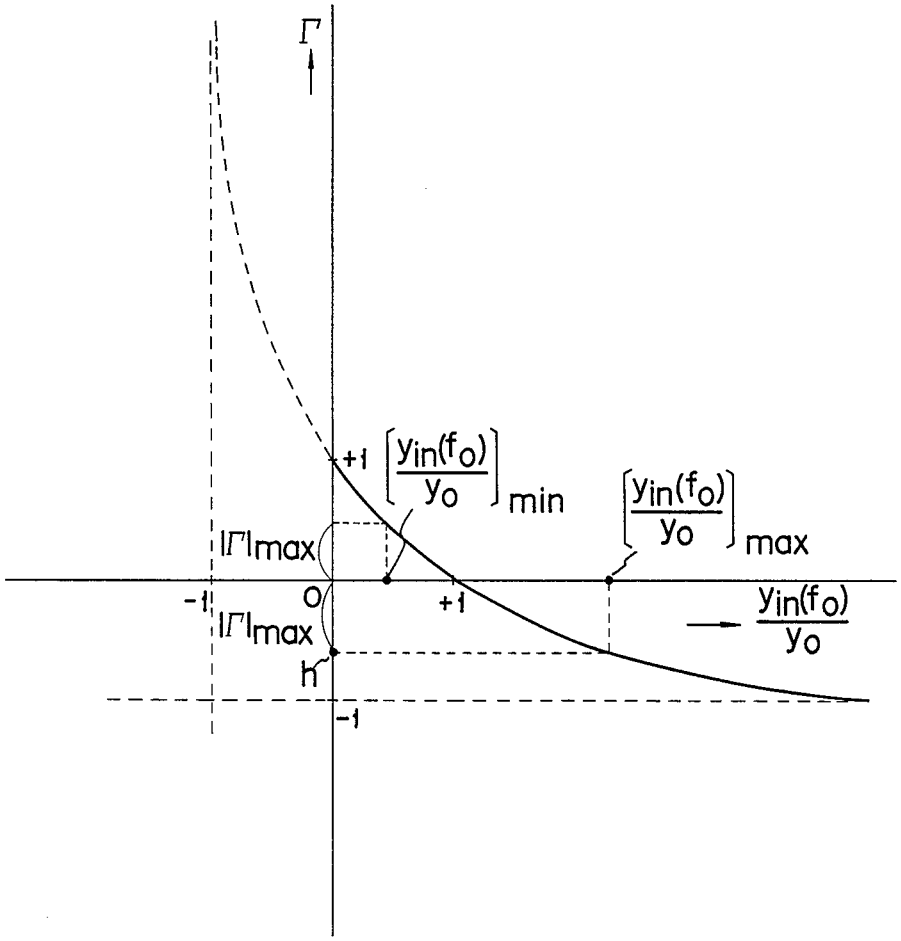
FIG. 4 is a graph showing the reflection coefficient versus normalized input admittance characteristics for the antenna shown in FIG. 1.

This relationship between normalized input impedance of the antenna $y_{in}(f_o)/y_o$ and the reflection coefficient is graphically shown in FIG. 4. It can be seen from FIG. 4 that Γ begins to slowly decrease from the value +1 as $y_{in}(f_o)/y_o$ increases from 0. Γ decreases to 0 at the point where $y_{in}(y_o)/y_o=+1$ namely $y_{in}(f_o)$ equals to the standard admittance of the transmission line $y_o$. Γ becomes negative as $y_{in}(f_o)/y_o$ increases, and approaches the value −1 as $y_{in}(f_o)/y_o$ continues to increase. If the maximum value of Γ which can be permitted in the transmission line is designated as $|\Gamma|$max, then Γ can be varied in the following range.

$$-|\Gamma|\max \leqq \Gamma \leqq |\Gamma|\max \tag{16}$$

In considering the input admittance normalized by the standard admittance of the transmission line at the point where Γ is $-|\Gamma|$max and $+|\Gamma|$max at $[y_{in}(f_o)/y_o]$max and $[y_{in}(f_o)/y_o]$min respectively, the following relationships from equation (15) can be obtained:

$$\left(\frac{y_{in}(f_o)}{y_o}\right)_{max} = \frac{1 + |\Gamma|_{max}}{1 - |\Gamma|_{max}} \tag{17}$$

$$\left(\frac{y_{in}(f_o)}{y_o}\right)_{min} = \frac{1 - |\Gamma|_{max}}{1 + |\Gamma|_{max}} \tag{18}$$

Expressing the VSWR as Smax when Γ equals $|\Gamma|$max, equations (17) and (18) can be rewritten as follows by considering the relattionship shown by equation (14):

$$\left(\frac{y_{in}(f_o)}{y_o}\right)_{max} = \frac{1 + |\Gamma|_{max}}{1 - |\Gamma|_{max}} = S_{max} \tag{19}$$

$$\left(\frac{y_{in}(f_o)}{y_o}\right)_{min} = \frac{1 - |\Gamma|_{max}}{1 + |\Gamma|_{max}} = \frac{1}{S_{max}} \tag{20}$$

It should be understood from equation (19), (20) that the normalized admittance $[y_{in}(f_o)/y_o]$ can range from minimum value 1/Smax to the maximum value Smax for a given allowed standing wave ratio Smax. Thus, the matching condition is established between the antenna and the feeder as long as the value of $[y_{in}(f_o)/y_o]$ remains between Smax and 1/Smax.

The following discussion considers the extent of variation of resonant frequency allowed while maintaining matching. Referring back to FIG. 3, the curve I shows the variations of input admittance $y_{in}(f_o)$ of the tuned loop antenna normalized by the constant $y_{in}(f_m)$ for the various resonant frequencies $f_o$, obtained by varying capacitor 2. As seen from FIG. 3 the coordinates of $y_{in}(f_o)$ is plotted so that the minimum value of $y_{in}(f_o)$ (i.e., $y_{in}(f_m)$) is equal to unity. Because $y_o$ is a constant value, the normalized admittance $y_{in}(f_o)/y_o$ varies in substantially the same manner for the normalized resonant frequencies $f_o/f_m$ as $y_{in}(f_o)$ in FIG. 3. The only difference between the graph of $y_{in}(f_o)$ (FIG. 3) and a graph of $y_{in}(f_o)/y_o$ (not shown) is the difference in the scale of the vertical axis.

Therefore, the range in which the resonant frequency $f_o$ is allowed to vary when $y_{in}(f_o)/y_o$ varies from its minimum value 1/Smax to its maximum value Smax can be obtained by the following calculations. First, the scale of the ordinate axis of FIG. 3 is multiplied by 1/Smax and converted into new ordinate axis. Second, the frequency range is obtained when $y_{in}(f_o)$ is equal to or less than Smax in the new ordinate axis. These calculations can be expressed as follows:

$$y_{in}(f_o)/S\max \leqq S\max \text{ or } y_{in}(f_o) \leqq (S\max)^2 \tag{21}$$

Equation (21) can also be expressed as follows:

$$\sqrt{y_{in}(f_o)} \leqq S_{max} \tag{22}$$

It is clear from equation (22), that the square root of $y_{in}(f_o)$ along the ordinate axis of FIG. 3 corresponds to Smax. This is shown by the other ordinate axis at the right hand side of FIG. 3; the values correspond to maximum VSWR allowed for various capacitive values. For example, the admittance when Smax=1.5 and Smax=2.0, can be calculated using equation (21):

$y_{in}(f_o) \leqq S^2\max = 1.5^2 = 2.25$, and
$y_{in}(f_o) \leqq S^2\max = 2.0^2 = 4.0$ The permissible frequency ranges to prevent exceeding the maximum VSWR selected in the above example can be found by obtaining the corresponding data from the abscissa axis of FIG. 3. Thus, $f_o/f_m = 0.4-2.2$, when Smax=1.5 and
$f_o/f_m = 0.3-3.0$, when Smax=2.0 as shown by dotted lines III and IV, respectively. Matching can therefore be obtained satisfying respectively VSWR less than 1.5 and VSWR less than 2.0 over the wide frequency bands of 2.46 octaves when Smax=1.5, and 3.32 octaves when Smax=2.0. Thus, the resonant frequency $f_o$ can be varied over the wide bands of 2.46 octaves or 3.32 octaves with VSWR less than 1.5 or 2.0 respectively.

As is well known in the prior art, the Smax value indicating matching required for FM radio and VHF television receiving antennas is usually selected to be approximately 3.0 and 2.5 for UHF television receiving antennas.

As previously discussed, radiation efficiency or gain and impedance matching are very important for small loop antennas. Radiation efficiency of an antenna $\eta$ is defined as the ratio of effective radiation power from the antenna to the input power of the antenna. According to antenna theory, the efficiency $\eta$ of an antenna is defined by the following equation:

$$\eta = R_r/(R_r + R_l) \tag{23}$$

where $R_r$ and $R_l$ are radiation resistance and loss resistance, respectively, defined by equations (2) and (3). Equations (2), (3) and (10) can be rewritten as follows:

$$R_l/R_r = 1.33(f_o/f_m)^{-3.5} \tag{24}$$

Substituting equation (24) into equation (23) the following expression is obtained:

$$\eta = \frac{1}{1 + 1.33\left(5\frac{f_o}{f_m}\right)^{-3.5}} \tag{25}$$

Gain of an antenna G is defined as the ratio of power radiated from the antenna in a certain direction to input power of the antenna. Gain G is usually expressed in decibels (dB) as compared with the gain of a half wavelength dipole antenna. Therefore, there is a close relationship between efficiency and gain of an antenna as described by the following equation:

$$G = 10 \log \eta - 0.39 \tag{26}$$

Equation (26) can thus be rewritten with equation (25) as follows:

$$G = 10\log\left\{\frac{1}{1 + 1.33\left(\frac{f_o}{f_m}\right)^{-3.5}}\right\} - 0.39 \tag{27}$$

It is clear from equation (27) that antenna gain is also a function of the normalized resonant frequency $f_o/f_m$.

Figure 5:
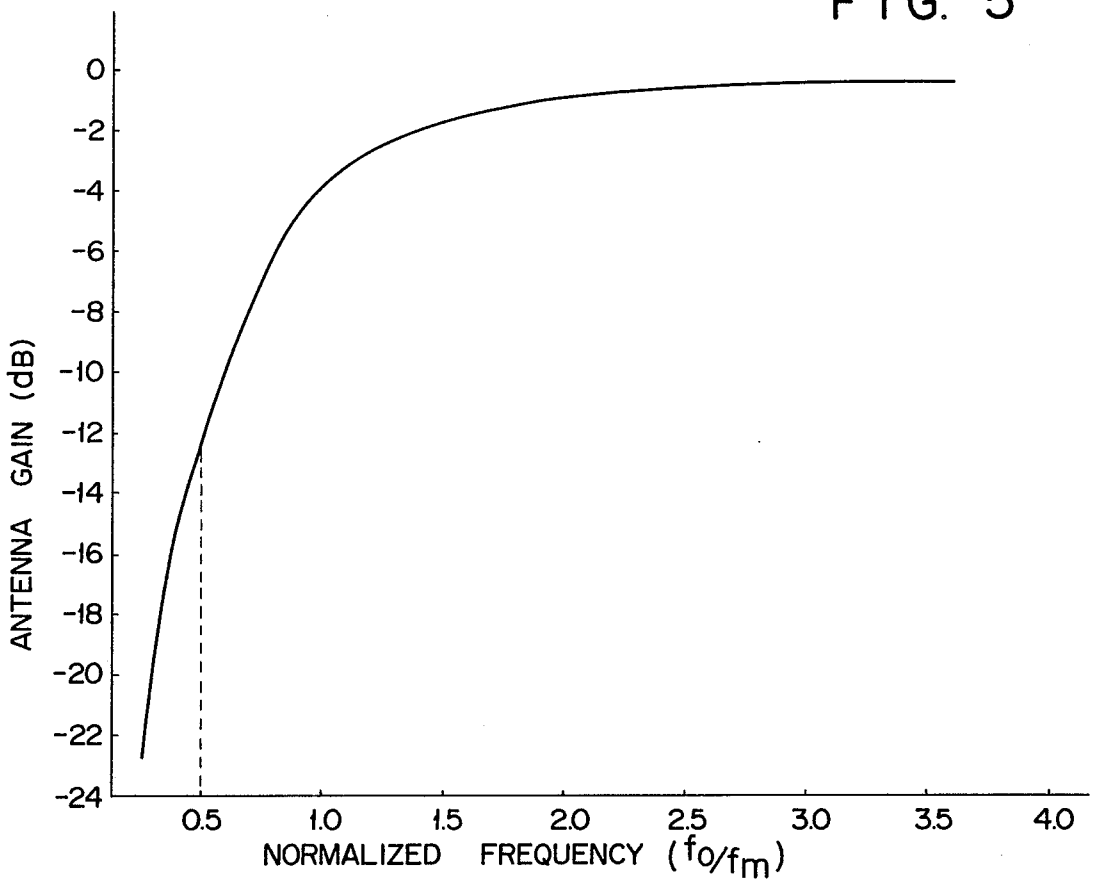
FIG. 5 is a graph of the gain versus the ratio ($f_o/f_m$) of the antenna shown in FIG. 1.

FIG. 5 shows a graph of equation (27). From this graph it is clear that the antenna in accordance with the instant invention can be be utilized over an extremely wide frequency range. It can be seen from FIG. 5 that gain decreases rapidly in the range where $f_o/f_m$ is less than 0.5. The gain is −12.5 dB at the point where $f_o/f_m = 0.5$; this gain, in any event, is large enough for small loop antennas.

Thus, according to this invention, the small tunable loop antenna should be designed so that $f_m$ (determined by the structural parameter M of the antenna) and $f_o$ (the resonant frequency selected by capacitor 2) provide a ratio within the following ranges:

$$0.5 \leqq f_o/f_m \leqq 3.0 \tag{28}$$

Consequently, with the antenna design of the instant invention, it is possible to have a VSWR of not more than 2.0 and a gain of not less than −12.5 db even when the resonant frequency $f_o$ is varied over a range of 3.32 octaves or more.

More specifically, the frequency $f_m$ is defined by equation (9) and the structural parameter of the antenna is given by the loop area A, loop circumferential length S, and conductor radius (b) as shown by equation (5). Therefore, it is possible to select the value of $f_m$ which provides the minimum input admittance $y_{in}(f_m)$ desired for the antenna. According to equation (10), the longer the circumferential length of loop conductor S, the higher the frequency $f_m$; the larger the loop area A or radius b, the smaller the frequency $f_m$. On the other hand, resonant frequency $f_o$ is varied by capacitor 2 for tuning in a desired broadcasting station among many different stations when the antenna is used for receiving. Thus, if frequency $f_m$ is selected to satisfy equation (28) for the different resonant frequencies $f_o$ covering such a frequency range (e.g., FM radio and VHF or UHF television frequency bands), impedance matching can be fully maintained despite the fixed tap position.

The self inductance $L_s$ of the section length $l_s$ of the loop conductor should be determined by rewritting equation (25) as follows:

$$\frac{f_o}{f_m} = 1.1\left(\frac{1}{\eta} - 1\right)^{-\frac{2}{7}} \tag{29}$$

Substituting equation (30) into equation (11), the following expression is obtained:

$$y_{in}(f_o) = kf_o^2\eta^{-1} \tag{30}$$

When matching impedance is established between the antenna and the feeder, the input admittance of the antenna $y_{in}(f_o)$ equals the standard admittance of the feeder $y_o$. Substituting $y_o$ for $y_{in}(f_o)$ in equation (30), the expression reduces to:

$$kf_o^2\eta^{-1} = y_o \tag{31}$$

Substituting equation (7) into equation (31), provides the following expression for self inductance:

$$L_s = \frac{10^{-16}\pi^2 Af_o}{\sqrt{y_o\eta}} - M_{sp} \tag{32}$$

Mutual inductance $M_{sp}$ between $l_s$ and section $l_p$ is smaller than the self inductances of sections $l_s$ and $l_p$. Consequently, the expression (32) can be rewritten as:

$$L_s \approx \frac{10^{-16}\pi^2 Af_o}{\sqrt{y_o\eta}} \tag{33}$$

The self inductance of the entire loop conductor, having a total length $S = l_s + l_p$, is expressed as follows:

$$L = \frac{\mu}{4\pi}\left(\log\frac{8a}{b} - \frac{3}{2}\right) \tag{34}$$

Therefore self inductance $L_p$ of the section $l_p$ is calculated as follows:

$$L_p = L - L_s = \frac{\mu}{4\pi}\left(\log\frac{8a}{b} - \frac{3}{2}\right) - \frac{10^{-16}\pi^2 Af_o}{\sqrt{y_o\eta}} \tag{35}$$

Figure 6A:
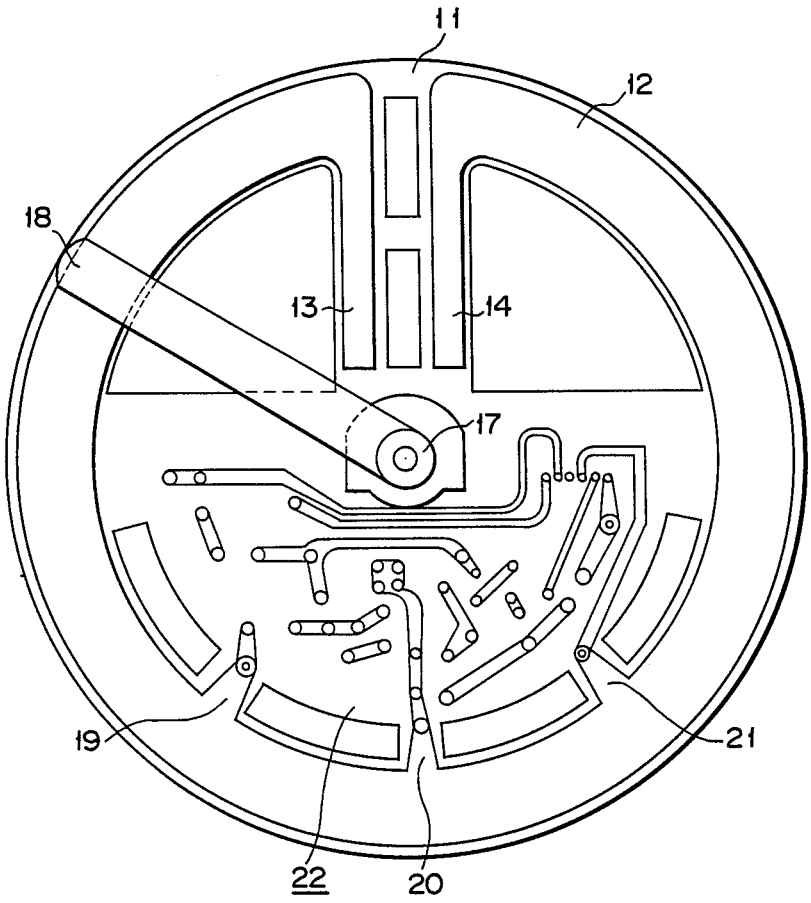
FIG. 6(A) and (B) are upper and bottom views, respectively.
Figure 6B:
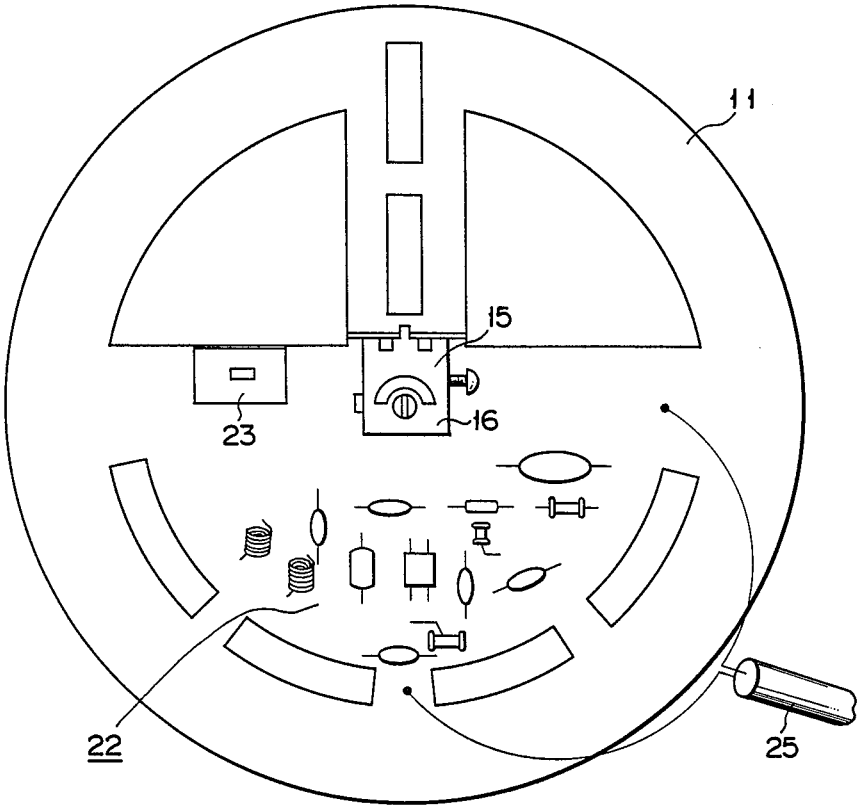
FIG. 6 is a plan view of the preferred embodiment of a small loop antenna in accordance with the invention.
Figure 8:
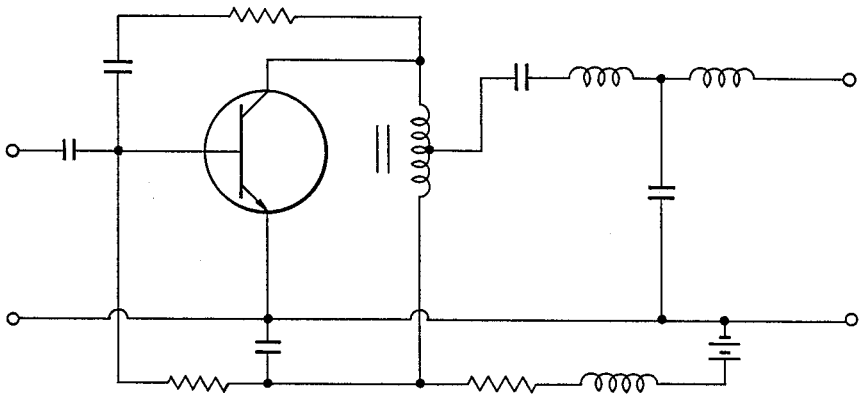
FIG. 8 is a detailed schematic diagram of the amplifier circuit shown in the schematic diagram of FIG. 7.

FIG. 6 shows the preferred embodiment of the tunable small loop antenna for receiving FM broadcasting according to the invention. In particular, FIG. 6(A) is an upper view and FIG. 6(B) is a bottom view. The loop conductor 12 is formed by etching copper foil placed on a circular substrate 11 with the desired mask (not shown). The ends of the loop conductor 13, 14 are extended towards the center of the substrate 11. Positioned between the ends is a variable air capacitor 15. Capacitor 15 comprises a body member 16, positioned on the bottom of substrate 11, and a rotor axis 17 projecting through to the upper side of the substrate 11. Element 18 is provided for rotating rotor axis 17 of variable air capacitor 15. One end of element 18 is affixed to rotor axis 17. Upon rotation of element 18, rotor axis 17 is thereby rotated for varying the capacitance of variable air capacitor 15. Three taps 19, 20 and 21 for feeding signals from the loop conductor 12 are provided. These taps are formed by etching the loop conductor so that it extends towards the center of substrate 11. A further description of the operation of these taps is provided below. An amplifier circuit 22 for amplifying signals received by the antenna is provided near the center portion of the substrate. The circuit diagram of amplifier 22 is shown in FIG. 8; it is designed to amplify wide band signals.

Figure 7:
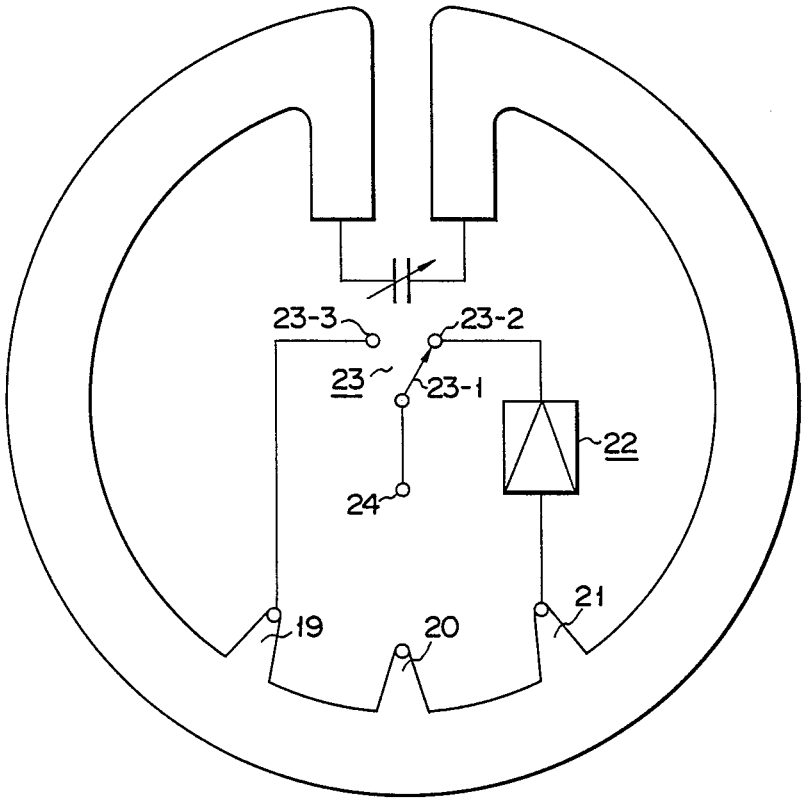
FIG. 7 is a systematic diagram of the antenna shown in FIGS. 6(A) and 6(B)

A switch 23 is mounted, as shown in FIG. 6(B), on the other side of substrate 11. Switch 23 operates to selectively provide the receiving signals to the amplifier 22. As shown in FIG. 7, when a movable contact 23-1 of switch 23 is connected to a fixed contact 23-2, the signal received by the antenna is provided to the amplifier 22 through tap 21. The signal amplified by the amplifier 22 is then supplied to the output terminals 24 through switch 23. The output signals of the antenna appears between the terminal 24 and the center tap 20. On the other hand, when movable contact 23-1 is connected to the other fixed contact 23-3, the received signals on tap 19 appear between output terminal 24 and tap 20, without amplification by amplifier 22. The output signal of the antenna is supplied through the coaxial transmission line 25 shown in FIG. 6(B).

The field intensity of the electromagnetic waves received by an antenna depends on the distance from the broadcasting station and the transmitting power of the station. Thus, it is desirable for a small antenna having relatively small gain to utilize an amplifier. It is undesirable, however, for an antenna to use an amplifier where high field intensity exists because of mixed modulation. Therefore, it is most desirable to selectively use the amplifier in accordance with the intensity of the field. According to the instant invention the selection or nonselection of amplifier 22 is performed by a single switch. The use of a single switch has important consequences for the small loop antenna since the attenuation caused by the presence of a switch is significant. Since the small loop antenna generally supplies a low intensity output signal, the presence of several switches can severely attenuate the output signal.

One example of a tunable small antenna design according to the present invention will now be explained. In Japan, for example, FM broadcasting frequency band ranges from 76 MHz to 90 MHz. In covering this entire band the resonant frequency $f_o$ must be varied within the following range:

$$f_o = 76\text{–}90 \text{ MHZ} \tag{36}$$

The value $f_m$ is then determined from the equation (28) for securing impedance matching and requisite antenna gain. Thus, the following value, for example, is selected:

$$f_m = 76 \text{ MHz} \tag{37}$$

From equation (36) and (37):

$$f_o/f_m = 1.00\text{–}1.18 \tag{38}$$

These values can be seen to fall within the range of equation (28). Various values of $f_o/f_m$ can be selected provided they are included within the ranges of equation (28).

It is desirable, however, to take into consideration the antenna gain by referring to FIG. 5. Generally, there is a conflict between gain and the size of the antenna, such that the higher the gain the larger the antenna. If the value of $f_m$ is determined, the structural parameter $M=A^2b/S$ is obtained from equation (10') as follows:

In equation (10') the permeability $\mu$ in air is defined as $$\mu=4\pi\times10^{-7}\ (\mathrm{H/m}) \tag{39}$$

and the conductivity $\sigma$ of the upper loop conductor is $$\sigma=5.81\times10^{7}\ (\mho/\mathrm{m}) \tag{40}$$

and the expression $\sqrt{\mu/\sigma}$ can then be calculated as:

$$\sqrt{\frac{\mu}{\sigma}} = 1.47\times10^{-7}\ (\mathrm{H}/\mho) \tag{41}$$

Substituting the value of (41) into equation (10'), the following expression is obtained:

$$(A^2b)/S=20.8\times10^{-7} \tag{42}$$

In the case of the loop antenna having a loop conductor of circular cross-section, as shown in FIG. 1, the structural parameter can be rewritten as follows:

$$\frac{A^2b}{S} = \frac{(\pi a^2)^2b}{2\pi a} = \frac{\pi a^3b}{2} = 20.8\times10^{-7} \tag{43}$$

However in the case of the loop antenna where the conductor is a circular strip or plate have a width W, an equivalent radius b, can be rewritten as follows:

$$b=W/4 \tag{44}$$

If the radius a of the loop of FIG. 6 is 0.05 m, radius b can be obtained from equation (36):

$$b=(2/\pi a^3)\times20.8\times10^{-7}=0.0053\ (\mathrm{m}) \tag{45}$$

Then the width W of the circular plate is calculated by equation (44) as follows:

$$W=4b=0.021\ (\mathrm{m}) \tag{46}$$

The loop area A and circumferential length S are respectively calculated as follows:

$$A=\pi a^2=0.00785\ (\mathrm{m}^2) \tag{47}$$

$$S=2\pi a=0.0314\ (\mathrm{m}) \tag{48}$$

Thus, a small antenna design is obtained with a loop diameter of 10 cm (i.e., about 3/100 of the wavelength used) and a conductor width of 2 cm. This novel design has a VSWR below 1.2 over the entire FM frequency band and a gain within the range of −4.1 dB to −2.8 dB. Conventional small antennas have a much smaller gain, for example, approximately −19.5 dB. Consequently, it should be clear that the tunable small loop antenna of the present invention has high performance characteristics compared with its size.

The loop conductor can be made of metals other than copper, such as aluminum Al, gold Au, silver Ag. The conductivity of the loop conductor for these other metals is as follows:

$$\begin{aligned}&\text{aluminum (Al)}—3.63\times10^{7}\ (\mho/\mathrm{m})\\&\text{gold (Au)}—4.16\times10^{7}\ (\mho/\mathrm{m})\\&\text{silver (Ag)}—5.17\times10^{7}\ (\mho/\mathrm{m})\end{aligned} \tag{49}$$

The ratio $\sqrt{\mu/\sigma}$ for each of these metals is thus:

$$\begin{aligned}\sqrt{\frac{\mu}{\sigma}} &= 1.86\times10^{-7}\ (\mathrm{Al})\\ \sqrt{\frac{\mu}{\sigma}} &= 1.74\times10^{-7}\ (\mathrm{Au})\\ \sqrt{\frac{\mu}{\sigma}} &= 1.56\times10^{-7}\ (\mathrm{Ag})\end{aligned} \tag{50}$$

Figure 9:
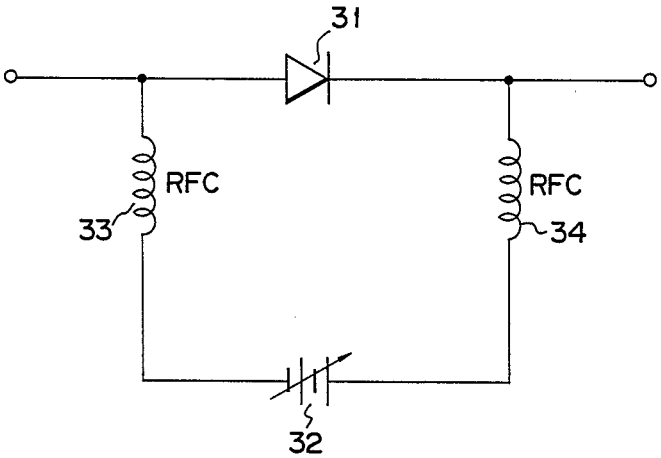
FIG. 9 is a schematic diagram of an alternative embodiment of an air variable capacitor used in the antenna shown in FIG. 6.

It should be noted that there may be various modifications to the present invention. For example, the air variable capacitor 2 can be replaced by a variable capacitance circuit using a variable capacitive diode 31, as shown in FIG. 9. A reverse bias DC voltage from a variable voltage source 32 is applied through high frequency eliminating coils 33 and 34. The variable capacitive diode circuit provides electrical tuning of the antenna. Therefore, it is possible to simultaneously adjust the resonant frequency of the antenna with the tuning of the receiver. In addition, capacitors can be used with fixed capacitance. Each capacitor can be selectively connected to the antenna circuit.

Figure 10:
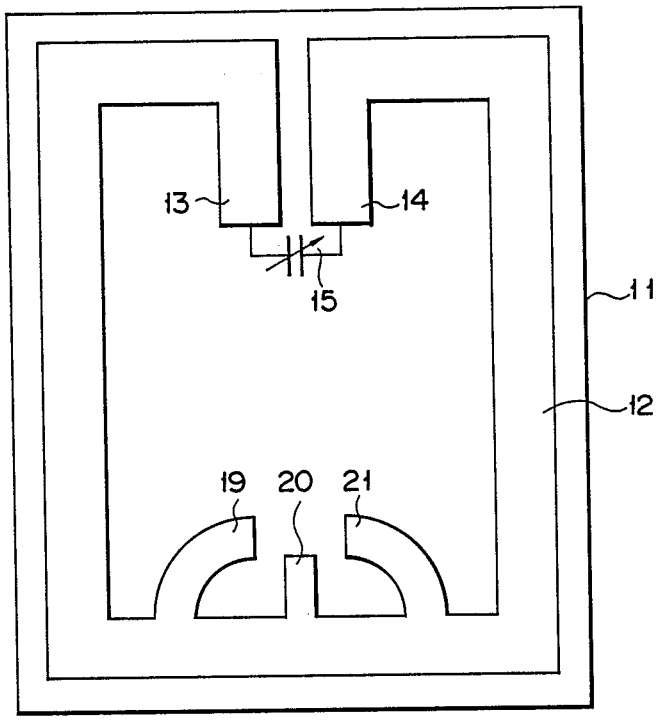
FIGS. 10 and 11 are alternative embodiments of an antenna designed in accordance with this invention.
Figure 11:
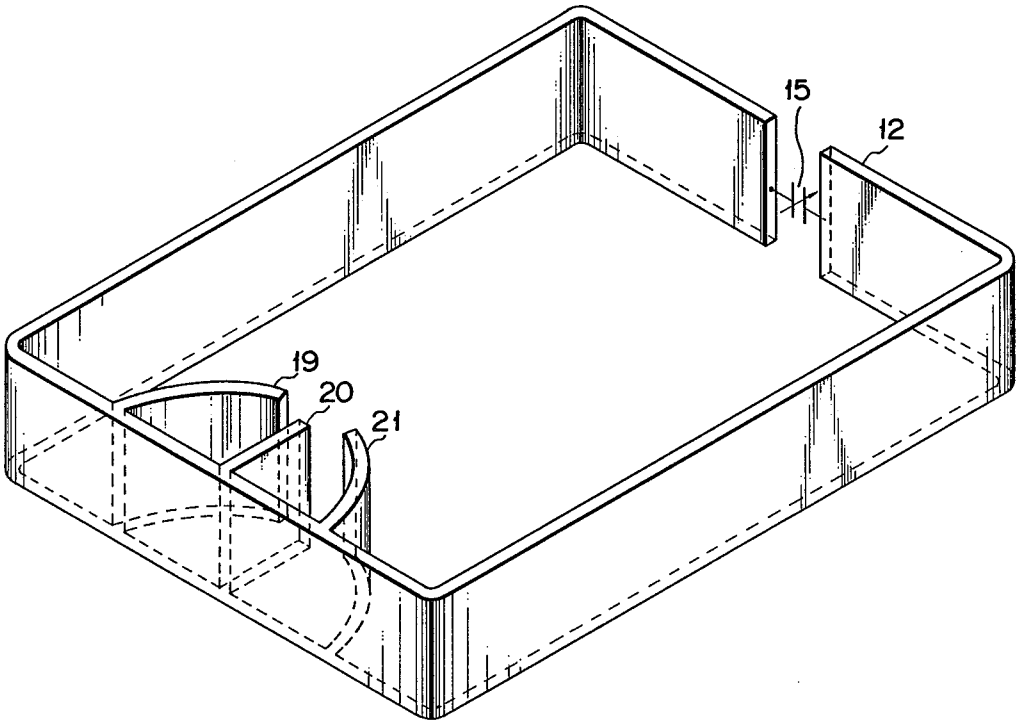

It should be noted that in accordance with this invention, the loop can be made in various shapes; for example, circular, square, elliptical, etc. FIG. 10 shows a square loop embodiment. FIG. 11 is a embodiment of a square loop antenna wherein the loop conductor comprises an errect plate. Such an antenna design can be conveniently installed within the narrow case of partable radio receivers and cordless telephone receivers. Furthermore, this antenna design can be easily made by bending a single metal sheet. It has the advantage of permitting efficient use of the metal sheet material, without waste. The operation and other design considerations of the antennas shown in FIGS. 10 and 11 are principally the same as described with reference to FIGS. 6 and 8. Further explanation is omitted, the numbers used correspond to those used in FIGS. 6 and 8.

Figure 12:
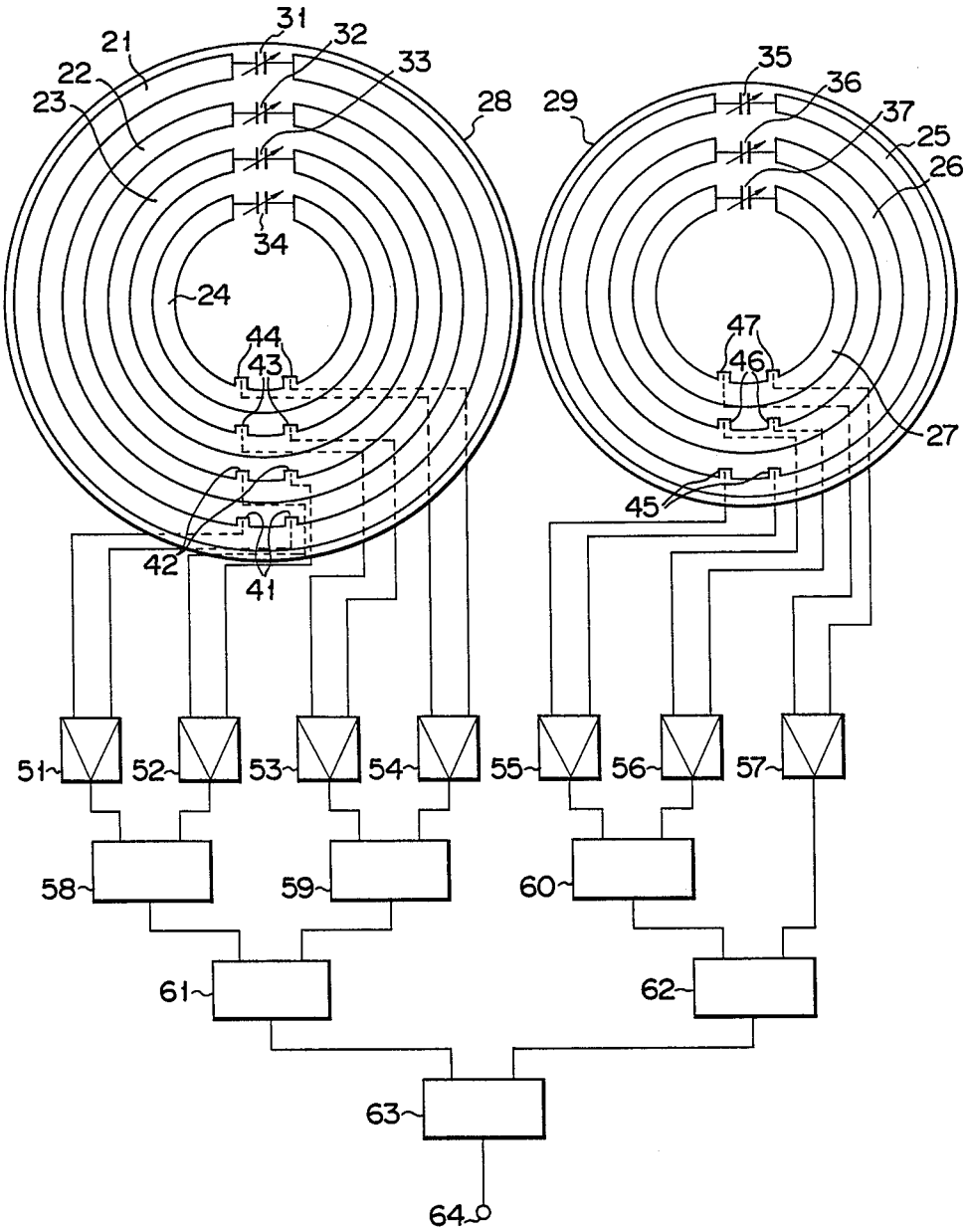
FIG. 12 is a schematic diagram of an application of the antenna designed in accordance with the instant invention.

FIG. 12 shows a further embodiment of the instant invention wherein the antenna is designed for the reception of television broadcasting signals. Four loop conductors, each having a different radius 21–24, and three loop conductors, each having a different radius 25–27, are coaxially formed on the substrates 28 and 29, respectively, using etching technique as explained in relation to FIG. 6. Separate variable capacitors 31–37 are connected in series with each loop conductor to form separate loop antennas. Each loop antenna is designed to tune in, among different television broadcasting channels, the central frequency of a certain channel. And each loop conductor is designed so that the $f_m$ value defined by the structural parameter of each loop conductor satisfies the conditions of equation (28).

In Japan, for example, twelve different channel frequencies are available for television broadcasting. The frequency range and central frequency of each channel are shown in Table 1.

TABLE 1

| channel no. | range of frequency [MHz] | central frequency [MHz] | loop conductor No. | diameter of loop conductor [cm] | width of loop conductor [cm] |
|---|---|---|---|---|---|
| 1 | 90–96 | 93 | 21 | 30.0 | 2.0 |
| 2 | 96–102 | 99 | | | |
| 3 | 102–108 | 105 | 22 | 27.2 | 2.0 |
| 4 | 170–176 | 173 | 23 | 24.1 | 2.0 |
| 5 | 176–182 | 179 | | | |
| 6 | 182–188 | 185 | 24 | 18.1 | 2.0 |
| 7 | 188–194 | 191 | | | |
| 8 | 192–198 | 195 | 25 | 18.1 | 1.5 |
| 9 | 198–204 | 201 | | | |
| 10 | 204–210 | 207 | 26 | 14.1 | 2.0 |
| 11 | 210–216 | 213 | | | |
| 12 | 216–222 | 219 | 27 | 12.1 | 2.0 |

Some of these channels are usually used in each service area. For example, in the Tokyo district, seven channels (i.e., 1st ch., 2nd ch., 4th ch., 6th ch., 8th ch., 10th ch. and 12th ch.) are practically used for broadcasting. Therefore each loop antenna 21–27 of FIG. 12 is designed to tune in the central frequency of a corresponding channel. This tuning occurs by adjusting the corresponding capacitive element 31–37 when used in the Tokyo district. The number of the loop antennas, the diameters of the loop conductor (2a+2b) and the width of the loop conductors of each antenna shown in FIG. 12 are correspondingly shown in the Table 1.

Output signals which are received by the antenna 21–27 are supplied from each feeding terminal 41–47 and then amplified by high frequency broad band amplifiers 51–57. The output signals of amplifiers 51–57 are supplied to coupling circuits 58, 59, and 60. Each coupling circuits are well known in the art as 3 dB couplers. Coupling circuits 58, 59 and 60 couple the output signals of two of the amplifiers 51–57 into one output signal having one half the input signal amplitude. The output signals of couplers 58 and 59 are supplied to a second coupling circuit stage 61. The output signals of coupling circuit 60 and amplifier 57 are supplied to a second coupling circuit stage 62. A third coupling circuit stage 63 couples the output signal of couplers 61 and 62 and provides a signal to the antenna output terminal 64. The amplitude of each signal is decreased by 9 dB while passing through the three 3 dB stages; each amplifier 51–56, however, compensates for this attenuation of the signals. Amplifier 57 is designed to compensate a 6 dB attenuation, since the signal passes through only two couplers 62 and 63. The antennas of FIG. 12, can be formed on substrate using printed circuit techniques; thus, it can be compactly formed for convenient installation in a television receiving set.

As discussed above, it is usually the case that different channels are used in the different service areas. For example, in the Hiroshima district of Japan, the 3rd ch., 4th ch., 7th ch. and 12th ch. are used for broadcasting. If using the antenna of FIG. 12 in this district, either capacitor 34 or 35 of antenna 24 and 25 which are turned to adjacent channels (i.e., 6th and 8th channels) is adjusted to tune in the central frequency, 191 MHz, of the 7th channel. In the Asahikawa district of Japan, the 2nd ch., 7th ch., 9th ch. and 11th channel are used for broadcasting. The respective capacitors of antenna 21, 24, 25 and 26 are adjusted to tune in to the central frequencies of corresponding channels.

The loaded Q of the television receiving antenna should be lower than that of FM radio receiving antenna because the frequency band of television signals is wider than the FM signals. As is known, the loaded Q is defined as the ratio of resonant frequency $f_o$ to the frequency band B. In the case of television signals, the frequency band usually has the range of 4–5 MHz. Thus, the loaded Q of the loop antenna for receiving the signals of the 1st channel is selected to be 93/4=23. In the case of the 2nd channel, loaded Q is selected to be 99/4=24, while 219/4=55 is selected for 12th channel. Therefore, the loaded Q of the television receiving antenna is required to have a 20–60 range. On the other hand, the frequency band of FM radio broadcasting is about 200 KHz, thus the loaded Q is selected to be 380–450. However, in the case of FM receiving antennas, the loaded Q is selected to having a range of 100–200.

The loaded Q of an antenna indicates the sharpness of resonance; it is a function of the circumferential length of the loop conductor S, the width of strip loop conductor W, loop area A, and the resistance of the loop conductor and capacitor. Generally, the larger the loop area A or the longer the circumferential length S, the smaller the loaded Q. The larger the width W, the larger the loaded Q. Therefore, it is desirable to adjust the loaded Q by selecting the loop area A, the circumferential length S and conductor width W while maintaining the ratio $f_o/f_m$ within the range of equation (28).

I claim:

1. A tunable small closed loop antenna, having an input admittance, for transmitting or receiving signals within the VHF and UHF frequency band and tunable over a wide range of resonant frequencies while substantially maintaining impedance matching between the antenna and an antenna feeder line comprising:

a loop conductor having a loop area A, circumferential length S and equivalent conductor radius b;

said loop conductor including feeding taps circumferentially spaced on said conductor wherein said taps are coupled to said antenna feeder line;

a capacitive element connected in series with said loop conductor for providng a resonant circuit having a loaded Q of not less than 20; characterizing in that said loop area, said circumferential length and said equivalent radius are selected so that the ratio of the resonant frequency $f_o$ of said resonant circuit and the resonant frequency fm, at which said input admittance is a minimum, is within the range: $0.5 \leqq f_o/f_m \leqq 3.0$ whereby the selected values of A, S and b satisfy the following equation:

$$\frac{A^2 b}{S} = 5.43 \times 10^{28} \sqrt{\frac{\mu}{\sigma}} \cdot f_m^{-\frac{7}{2}}$$

where $\mu$ is the permeability of the medium and $\sigma$ is the conductivity of the loop conductor, and $f_m$ has a value which falls within said range for various resonant frequencies $f_o$ existing within a predetermined frequency band.

2. A tunable small loop antenna according to claim 1, wherein the capacitive element is a variable capacitive element for adjusting said resonant frequency.

3. A tunable small loop antenna according to claim 2, having a maximum size of less than one tenth of the wavelength.

4. A tunable small loop antenna according to claim 3, wherein said loop conductor is formed on a non-conductive substrate by etching techniques and said capacitive element is mounted near a center portion of said substrate.

5. A tunable small closed loop antenna for receiving signals within the VHF and UHF frequency band comprising:

a first closed loop antenna having an input admittance, a loop area A, circumferential length S and equivalent conductor radius b comprising a first capacitive element connected in series with the said first loop conductor for providing a resonant circuit having a loaded Q of not less than 20;

a second closed loop antenna having an input admittance, a loop area A, circumferential length S and equivalent conductor radius b, said second antenna having a maximum size which is less than said first loop antenna comprising a second capacitive element connected in series with said second loop conductor for providing a resonant circuit having a loaded Q of not less than 20;

each of said loop conductor including a pair of feeding taps circumferentially spaced on each conductor wherein each tap pair has an input admittance;

means for coupling output signals produced on said feeding taps of said first and second closed loop antenna to an antenna output terminal;

characterizing in that the loop area conductor, the circumferential length and the equivalent radius of each of said antennas are selected so that the ratio of the resonant frequency $f_o$ of its resonant circuit and the resonant freqency $f_m$, at which said input admittance is a minimum, is within the range:

$$0.5 \leqq f_o/f_m \leqq 3.0,$$

whereby the selected values of A, S and b for each of said loop conductors satisfy the following equation:

$$\frac{A^2b}{S} = 5.43 \times 10^{28} \sqrt{\frac{\mu}{\sigma}} \cdot f_m^{-\frac{7}{2}}$$

where $\mu$ is the permeability of medium and $\sigma$ is the conductivity of the loop conduction, and $f_m$ has a value which falls within said range for various resonant frequencies $f_o$ existing within a predetermined frequency band.

6. A tuned small loop antenna according to claim 5, wherein the first and second capacitive elements are variable capacitive elements for adjusting the resonant frequency of the first loop antenna and the second loop antenna, respectively.

7. A tunable small loop antenna according to claim 6, wherein said first and second antennas each comprise a loop conductor having an annular configuration and are concentrically disposed on a substrate.

8. Method for designing a tunable small closed loop antenna having a loop conductor with, a loop area A, a circumferential length S and equivalent radius b, a capacitive means connected in series with said loop conductor for providing a resonant circuit over a wide range of frequencies while substantially maintaining impedance matching between said antenna and an antenna feeder, said loop conductor including feeding taps circumferentially spaced on said conductor wherein said taps are coupled to said antenna feeder line comprising the steps of:

adjusting the ratio of the resonant frequency $f_o$ of the resonant circuit and the resonant frequency $f_m$, at which the input admittance is a minimum, to be within the range:

$$0.5 \leqq f_o/f_m \leqq 3.0,$$

selecting the value of $f_m$ which falls within said range for various resonant frequencies $f_o$ existing within a predetermined frequency band;

selecting the values of S, A and b from the following equation:

$$\frac{A^2b}{S} = 5.43 \times 10^{28} \sqrt{\frac{\mu}{\sigma}} \cdot f_m^{-\frac{7}{2}}$$

where $\mu$ is the permeability of medium and $\sigma$ is the conductivity of the loop conductor.

9. A tunable small loop antenna, having an input admittance, for transmitting or receiving signals within the VHF and UHF frequency band and tunable over a wide range of resonant frequencies while substantially maintaining impedance matching between the antenna and an antenna feeder line comprising:

a loop conductor having a loop area, circumferential length and equivalent conductor radius;

a capacitive element connected in series with said loop conductor for providing a resonant circuit having a loaded Q of not less than 20; wherein said loop area, said circumferential length and said equivalent radius are selected so that the ratio of the resonant frequency $f_o$ of said resonant circuit and the resonant frequency $f_m$, at which said input admittance is a minimum, is within the range:

$$0.5 \leqq f_o/f_m \leqq 3.0$$

feeding taps, circumferentially spaced on said conductor, wherein said feed taps include a first, a second and a third tap, said second tap being positioned between said first and third tap;

a first means for supplying the signals appearing between the first tap and the second tap directly to the output terminals of the antenna;

a second means, including a high frequency amplifier, supplying the signals appearing between the second tap and the third tap to output terminals of the antenna; and a switching means, coupled to first and second means, for selecting either said first means or said second means.

10. Method for designing a tunable small loop antenna having a loop conductor with, a loop area, a circumferential length and equivalent radius, a capacitive means connected in series with said loop conductor for providing a resonant circuit over a wide range of frequencies while substantially maintaining impedance matching between said antenna and an antenna feeder, comprising the steps of:

adjusting the ratio of the resonant frequency $f_o$ of the resonant circuit and the resonant frequency $f_m$, at which the input admittance is a minimum, to be within the range:

$$0.5 \leqq f_o/f_m \leqq 3.0;$$

selecting the value of $f_m$ which falls within said range for various resonant frequencies $f_o$ existing within a predetermined frequency band;

substituting the selected value $f_m$ in the following equation:

$$\frac{A^2b}{S} = 5.43 \times 10^{28} \sqrt{\frac{\mu}{\sigma}} \cdot f_m^{-\frac{7}{2}}$$

where $\mu$ is the permeability of medium and $\sigma$ is the conductivity of the loop conductor;

calculating the values of the loop area, the circumferential length and equivalent radius which satisfies said equation where A is the loop area, S is the length and b is the equivalent radius; and constructing a loop antenna having a loop area, length and radius selected from said calculated values.

* * * * *